US007222832B2

(12) United States Patent
Welker

(10) Patent No.: US 7,222,832 B2
(45) Date of Patent: May 29, 2007

(54) SUPPORT MECHANISM

(76) Inventor: Orville V. Welker, 1852 Queen Anne Ct., Wentzville, MO (US) 63385

( * ) Notice: Subject to any disclaimer, the term of this patent is extended or adjusted under 35 U.S.C. 154(b) by 709 days.

(21) Appl. No.: 10/722,044

(22) Filed: Nov. 24, 2003

(65) Prior Publication Data

US 2005/0121960 A1 Jun. 9, 2005

(51) Int. Cl.
*F16M 13/00* (2006.01)
*A47C 3/20* (2006.01)

(52) U.S. Cl. ..... 248/421; 248/157; 297/344.16

(58) Field of Classification Search ..... 297/344.16, 297/344.21; 248/421, 157
See application file for complete search history.

(56) References Cited

U.S. PATENT DOCUMENTS

| | | | | |
|---|---|---|---|---|
| 130,093 | A | 7/1872 | White | |
| 239,862 | A | 4/1881 | Shupe | |
| 317,000 | A | 5/1885 | Odell | |
| 1,143,195 | A | 6/1915 | Henderson | |
| 2,894,562 | A | 7/1959 | Peller | |
| 3,839,757 | A | 10/1974 | Grimes | |
| 3,886,611 | A | 6/1975 | Lammy et al. | |
| 3,964,725 | A | 6/1976 | Matsui et al. | |
| 4,726,317 | A | 2/1988 | Ritten et al. | |
| 5,209,178 | A | 5/1993 | Rowe | |
| 5,611,551 | A | 3/1997 | Lin | |
| 6,155,642 | A * | 12/2000 | Kawakami et al. | 297/344.16 X |
| 6,916,065 | B2 * | 7/2005 | Park | 297/344.21 X |

FOREIGN PATENT DOCUMENTS

| | | |
|---|---|---|
| EP | 0 560 256 A1 | 9/1993 |
| JP | 358199231 A | 11/1983 |
| JP | 405253031 A | 10/1993 |

* cited by examiner

*Primary Examiner*—Anthony D. Barfield
(74) *Attorney, Agent, or Firm*—Thompson Coburn LLP

(57) ABSTRACT

A support mechanism comprises a base member, first and second support arms, first and second synchronizing arms, and a load-supporting platform. The first support arm is connected to a pivot bracket and the based member in a manner to permit pivoting movement of the first support arm between stowed and deployed positions. The second support arm is connected to the pivot bracket and the load-supporting platform in a manner to permit pivoting movement of the second support arm relative to the load-supporting platform between stowed and deployed positions. The first and second synchronizing arms are also operatively connected to the based member, pivot bracket and load-supporting platform in a manner so that the first synchronizing arm and first support arm maintain a substantially parallel relationship with one another throughout the entire range of movement of the first support arm, and so that the second synchronizing arm and second support arm also maintain a substantially parallel relationship with one another throughout the entire range of movement of the second support arm.

30 Claims, 5 Drawing Sheets

SUPPORT MECHANISM

BACKGROUND OF THE INVENTION

This invention relates to support mechanisms and, more particularly, to seat-support mechanisms adapted for use with fishing boat seats. It is known in the art to provide fishing boat seats, which are movable between a deployed position (i.e., a generally elevated position) for use while fishing from the boat and a stowed position (i.e., a generally lowered position) for use while operating the boat. A deployed seat position, which is generally elevated from the boat's deck, is desirable because it provides the fisherman with an optimal view of his surroundings and more unobstructed space for operating fishing gear. A stowed position, in which the seat is generally adjacent the boat's deck, is desirable during operation of the boat, because it provides a lower center of gravity and greater stability while the boat is moving.

However, many prior art fishing boat seats, which are movable between such deployed and stowed positions, occupy an unnecessarily large amount of space on the boat's deck, leaving less room for fishing gear, etc. Moreover, in many cases, the support mechanisms for such movable boat seats are cumbersome and difficult to adjust between deployed and stowed positions, which is particularly undesirable in an environment where balance is already a challenge.

Thus, there is a need for an improved boat seat support mechanism. It is a principal object of the present invention to provide a boat seat support mechanism, which is structurally stable yet easy to adjust between deployed and stowed positions, without the need to manipulate complicated controls. It is also an object of the present invention to provide a boat seat support mechanism, which provides generally vertical (i.e., "over-the-center") movement of the seat between its deployed and stowed positions, so as to take up less space on the boat deck.

SUMMARY OF THE INVENTION

In general, a support mechanism for a seat comprises a base member, first and second support arms, first and second synchronizing arms, and a load-supporting platform. The base member is adapted for supporting the support mechanism from a support surface, such as a boat deck. The load supporting platform is adapted for supporting a seat.

The first support arm has a distal end pivotally connected to a pivot bracket and a proximal end operatively connected to the base member. The first support arm is connected to these components in a manner to permit pivoting movement of the first support arm relative to the support surface between a stowed position and a deployed position. The distal end of the first support arm is generally adjacent the support surface when the first support arm is in its stowed position and is spaced from the support surface when the first support arm is in its deployed position. The first synchronizing arm is generally adjacent to the first support arm. The first synchronizing arm has a distal end pivotally connected to the pivot bracket and a proximal end operatively connected to the base member in a manner to permit pivoting movement of the first synchronizing arm relative to the support surface. The first synchronizing arm and first support arm are operatively connected to the pivot bracket and base member in a manner so that the first synchronizing arm and first support arm maintain a substantially parallel relationship with one another throughout the entire range of movement of the first support arm between its stowed and deployed positions.

The second support arm has a distal end pivotally connected to the pivot bracket and a proximal end operatively connected to the load-supporting platform. The second support arm is connected to these components in a manner to permit pivoting movement of the second support arm relative to the load-supporting platform between a stowed position and a deployed position. The second synchronizing arm is generally adjacent to the second support arm. The second synchronizing arm has a distal end pivotally connected to the pivot bracket and a proximal end operatively connected to the load-supporting platform in a manner to permit pivoting movement of the second synchronizing arm relative to the load-supporting platform. The second synchronizing arm and second support arm are operatively connected to the pivot bracket and load-supporting platform in a manner so that the second synchronizing arm and second support arm maintain a substantially parallel relationship with one another throughout the entire range of movement of the second support arm between its stowed and deployed positions.

The first and second support arms and first and second synchronizing arms are operatively connected with one another in a manner so that the load-supporting platform moves substantially along a fixed vertical axis as the first and second support arms move between their respective stowed and deployed positions.

In another aspect of the invention, a seat support mechanism comprises a base member, first and second support arms, first and second synchronizing arms, and a load-supporting platform, all substantially as described above. In this aspect of the invention, the first and second support arms and first and second synchronizing arms are operatively connected with one another in a manner so that a first plane passing through the load-supporting platform and a second plane passing through the base member maintain a substantially parallel relationship with one another throughout the entire range of movement of the first and second support arms between their respective stowed and deployed positions.

In still another aspect of the invention, a boat seat support mechanism comprises a base member, first and second support arms, first and second synchronizing arms, and a load-supporting platform, all substantially as described above. In this aspect of the invention, a distal end of the first support arm includes a first geared portion, and a distal end of the second support arm has a second geared portion. The first and second support arms are connected to the pivot bracket in a manner so that the first and second geared portions are in meshed engagement with one another throughout the entire range of movement of the first and second support arms between their respective stowed and deployed positions. Thus, movement of one of the first and second support arms between its stowed and deployed positions requires corresponding movement of the other of the first and second support arms between its stowed and deployed positions.

Further objects, features, and advantages of the present invention, as well as the structure and operation of various embodiments of the present invention, are described in detail below with reference to the accompanying drawings.

Figure 2:
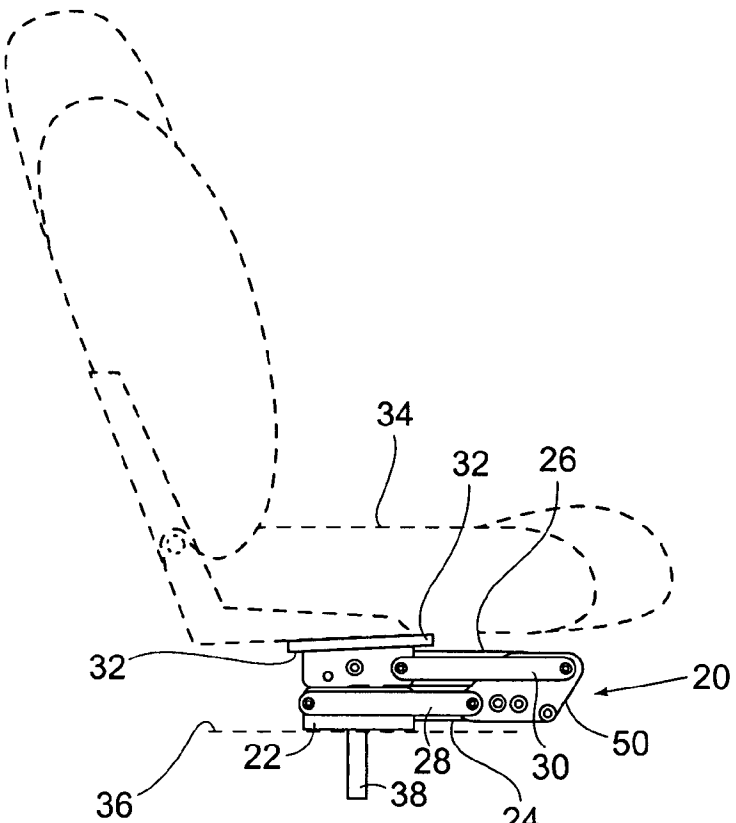
FIG. 2 is a side elevational view of the seat support mechanism of FIG. 1, but shown in a stowed position.

Reference characters used in these drawings correspond with reference characters used throughout the Detailed Description of the Preferred Embodiments, which follows. These drawings, which are incorporated in and form a part of the specification, illustrate the preferred embodiments of the present invention and, together with the description, serve to explain the principles of the invention.

DETAILED DESCRIPTION OF THE PREFERRED EMBODIMENTS

Figure 1:
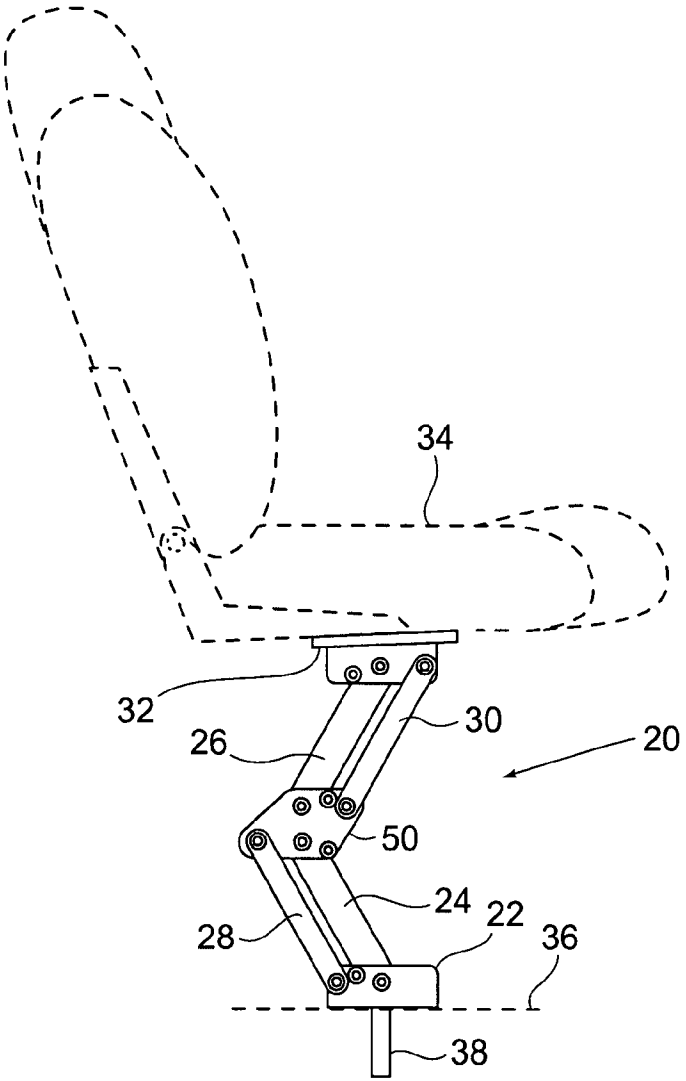
FIG. 1 is a side elevational view of the seat support mechanism of the present invention, shown in a deployed position.

A boat seat support mechanism of the present invention is represented generally by the reference numeral 20 in FIGS. 1–4. The support mechanism 20 comprises a base member or pedestal 22, a lower support arm 24, an upper support arm 26, lower synchronizing arms 28, upper synchronizing arms 30, and a load-supporting platform 32. FIGS. 1 and 2 also include broken line representations of a seat 34 and a support surface 36 (e.g., a boat deck), to illustrate an environment in which the present invention may be used. As explained below in more detail, the support mechanism 20 is movable between a deployed position (shown in FIG. 1), wherein the seat 34 is elevated above the support surface 36, and a stowed position (shown in FIG. 2), wherein the seat 34 is lowered and generally adjacent the support surface 36.

Figure 3:
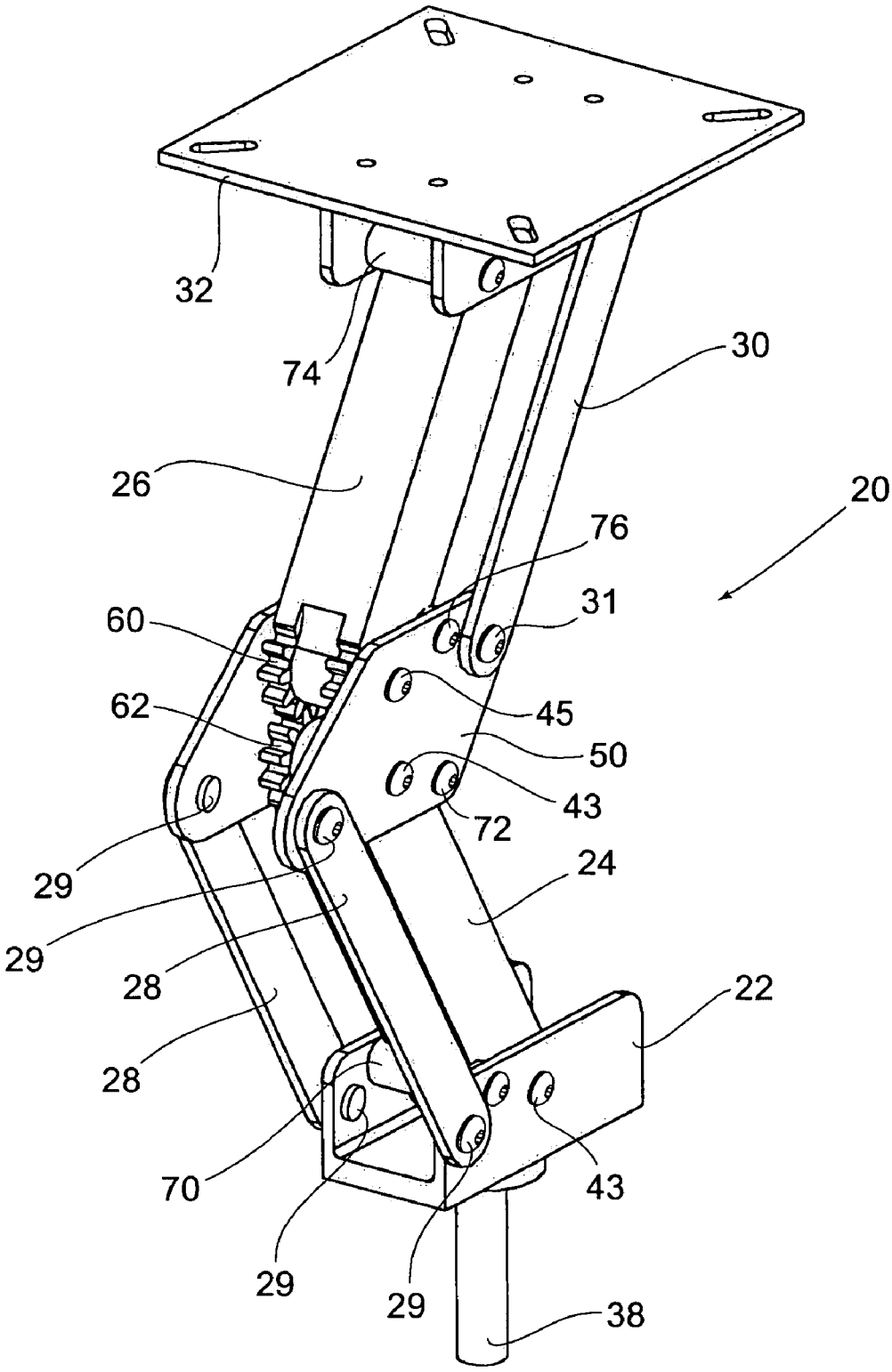
FIG. 3 is a perspective view of the support mechanism, shown in the deployed position.
Figure 4:
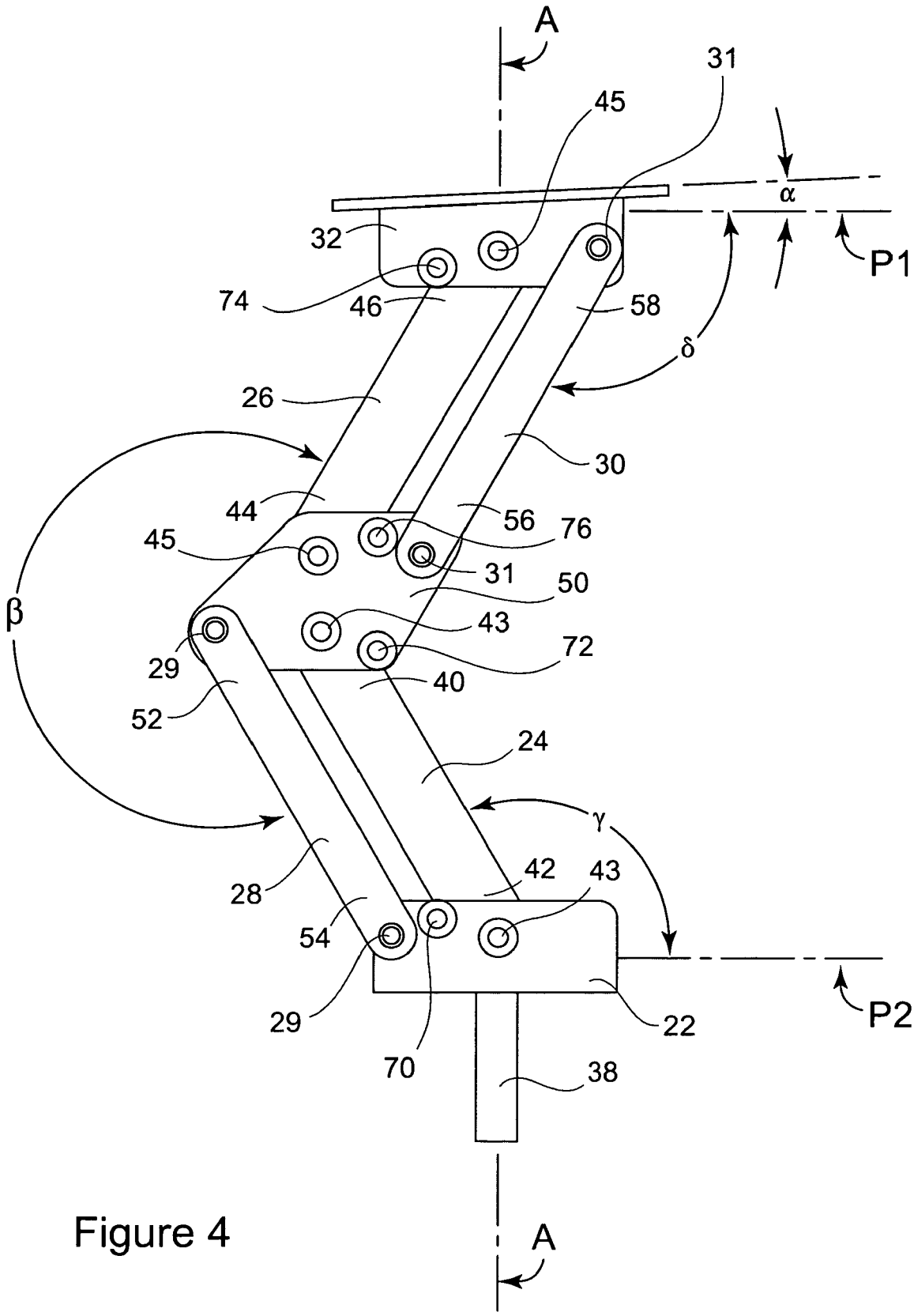
FIG. 4 is an enlarged side elevational view of the support mechanism, also shown in the deployed position.
Figure 7:
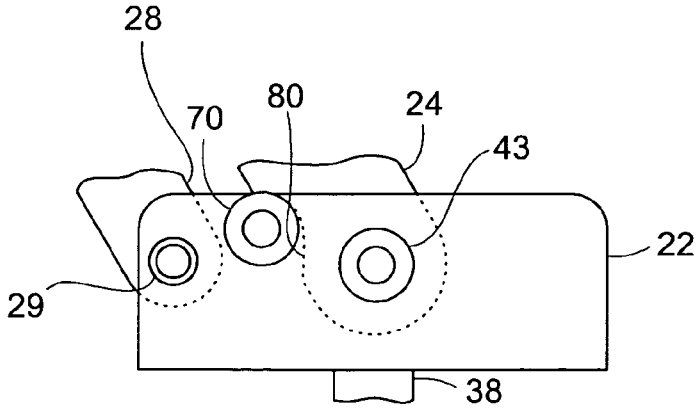
FIG. 7 is an enlarged side detail view of a base member used in the seat support mechanism of the present invention.

The base member 22 is adapted for supporting the support mechanism 20 from the support surface 36. As shown in FIGS. 3, 4 and 7, the base member preferably includes a generally vertical shaft 38, which adapted for insertion into a correspondingly dimensioned recess (not shown) in the support surface 36, and which permits rotation of the support mechanism 20 relative to the support surface 36 about a generally vertical axis A (see FIG. 4). This permits the fisherman to swivel the seat 34 about the axis A of the shaft 38, as desired. It should be understood, however, that the base member 22 could be connected with or mounted to the support surface 36 in another manner without departing from the scope of present invention, as set forth in the claims.

Figure 5:
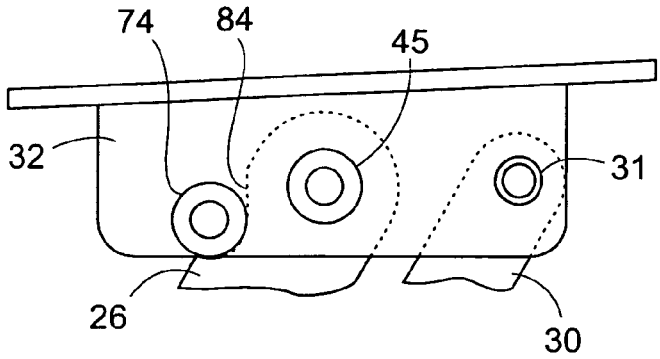
FIG. 5 is an enlarged side detail view of a load supporting platform used in the seat support mechanism of the present invention.

The seat 34 is secured to the load supporting platform 32 with mechanical fasteners (not shown) or in another appropriate manner, as is known the art. As shown in FIGS. 4 and 5, the load supporting platform 32 is preferably at a slight angle $\alpha$ relative to horizontal, so that the seat 34 secured thereto is also maintained at a slight angle, tilted slightly back for comfort and safety.

The lower support arm 24 has a distal end 40 pivotally connected to an intermediate pivot bracket 50 and a proximal end 42 operatively connected to the base member 22. Preferably, these components are connected with one another via mechanical fasteners 43. The lower support arm 24 is shown in detail in FIG. 9, and the pivot bracket 50 is shown in detail in FIG. 6. The lower support arm 24 is connected to the pivot bracket 50 and base member 22 in a manner to permit pivoting movement of the lower support arm 24 relative to the base member 22 and support surface 36 between its deployed position (shown in FIG. 1) and its stowed position (shown in FIG. 2). As shown in FIGS. 1 and 2, the distal end 40 of the lower support arm 24 is generally adjacent the support surface 36 when the lower support arm 24 is in its stowed position, and is spaced from the support surface 36 when the lower support arm 24 is in its deployed position.

The upper support arm 26 has a distal end 44 pivotally connected to the pivot bracket 50 and a proximal end 46 operatively connected to the load-supporting platform 32. Preferably, these components are connected with one another via mechanical fasteners 45. The upper support arm 26 is shown in detail in FIG. 8. The upper support arm 26 is connected to these components in a manner to permit pivoting movement of the upper support arm 26 relative to the load-supporting platform 32 and seat 34 between its deployed position (shown in FIG. 1) and its stowed position (shown in FIG. 2).

Figure 10:
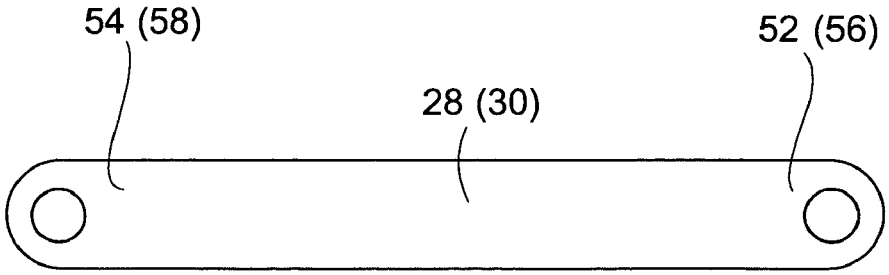
FIG. 10 is a side view a synchronizing arm used in the seat support mechanism of the present invention.

The support mechanism 20 comprises at least one lower synchronizing arm 28, but preferably a pair of such lower synchronizing arms 28, generally adjacent to the lower support arm 28. Preferably, these components are connected with one another via mechanical fasteners 29. One such synchronizing arm 28 is shown in detail in FIG. 10. Each of the lower synchronizing arms 28 has a distal end 52 pivotally connected to the pivot bracket 50 and a proximal end 54 operatively connected to the base member 22 in a manner to permit pivoting movement of the lower synchronizing arm 28 relative to the support surface 36. The lower synchronizing arms 28 and lower support arm 24 are all operatively connected to the pivot bracket 50 and base member 22 in a manner so that they all function together as a four-bar mechanism. Preferably, the lower synchronizing arms 28 have substantially the same length as one another, and are connected to the pivot bracket 50 and base member 22 in a manner so that their respective proximal ends are spaced from one another a distance that is substantially the same as the spacing of their respective distal ends. Thus, the lower synchronizing arms 28 and lower support arm 24 maintain a substantially parallel relationship with one another throughout the entire range of movement of the lower support arm 24 between its stowed and deployed positions.

The support mechanism 20 also comprises at least one upper synchronizing arm 30, but preferably a pair of such upper synchronizing arms 30, which are generally adjacent to the upper support arm 26. Preferably, these components are connected with one another via mechanical fasteners 31. The upper synchronizing arms 30 are essentially identical to the lower synchronizing arms 28, as shown in detail in FIG. 10. Each of the upper synchronizing arms 30 has a distal end 56 pivotally connected to the pivot bracket 50 and a proximal end 58 operatively connected to the load-supporting platform 32 in a manner to permit pivoting movement of the upper synchronizing arm 30 relative to the load-supporting platform 32. The upper synchronizing arms 30 and upper support arm 26 are all operatively connected to the pivot bracket 50 and load-supporting platform 32 in a manner so that the upper synchronizing arms 30 and upper support arm 26 all maintain a substantially parallel relationship with one another throughout the entire range of movement of the upper support arm 26 between its stowed and deployed positions. Thus, the upper synchronizing arms 30, upper support arm 26, pivot bracket 50 and load-supporting platform 32 all function together as a four-bar mechanism as well.

Figure 6:
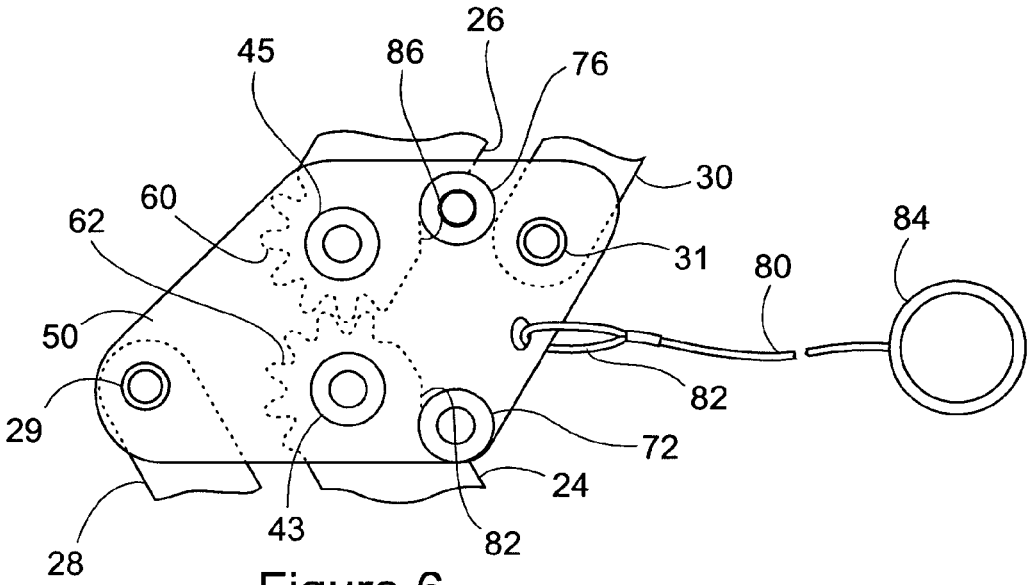
FIG. 6 is an enlarged side detail view of a pivot bracket used in the seat support mechanism of the present invention.
Figure 8:
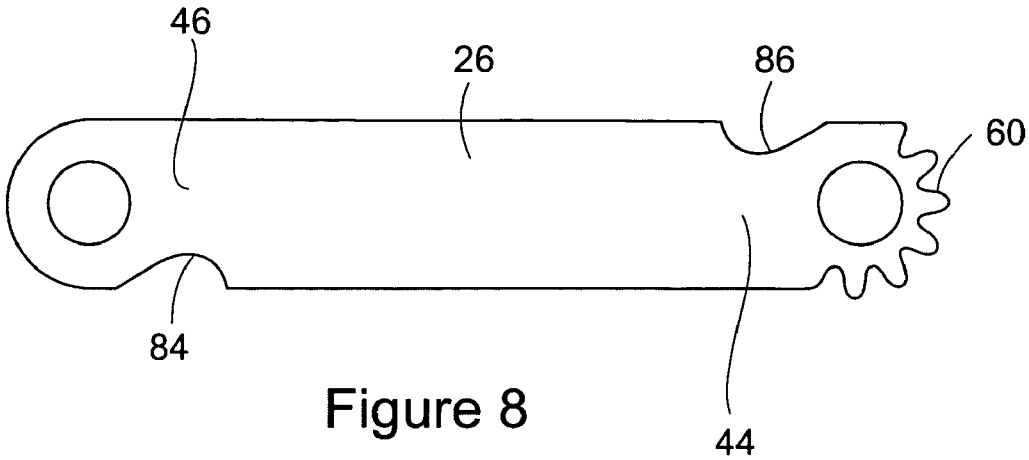
FIG. 8 is a side view of an upper support arm used in the seat support mechanism of the present invention.
Figure 9:
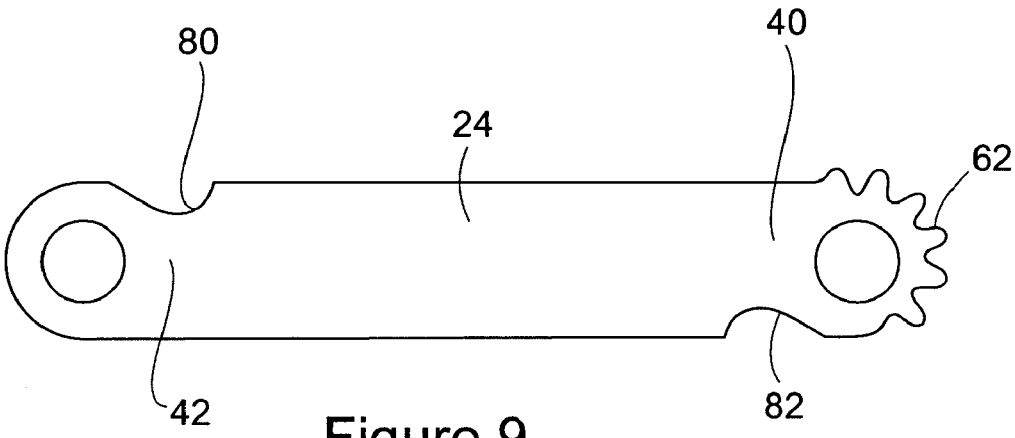
FIG. 9 is a side view of a lower support arm used in the seat support mechanism of the present invention.

As best shown in FIGS. 3, 6 and 8, the upper support arm 26 preferably includes a geared portion 60 at its distal end 44. Similarly, and as best shown in FIGS. 3, 6 and 9, the lower support arm 24 preferably includes a geared portion 62 at its distal end 40. As shown in FIGS. 3 and 6, the geared portions 60 and 62 of the upper and lower support arms 26 and 24 are preferably in meshed engagement with one another throughout the entire range of movement of the upper and lower support arms 26 and 24 between their respective stowed and deployed positions. Thus, due to the meshed engagement of the geared portions 60 and 62, pivoting movement of one relative to the pivot bracket 50 requires corresponding pivoting movement of the other. That is, movement of the upper support arm 26 between its stowed and deployed positions requires corresponding movement of the lower support arm 24 between its stowed and deployed positions, and vice versa. This, in turn, results in the lower "four-bar mechanism" (comprising the lower synchronizing arms 28, lower support arm 24, pivot bracket 50 and base member 22) and the upper "four-bar mechanism" (comprising the upper synchronizing arms 30, upper support arm 26, pivot bracket 50 and load-supporting platform 32) always moving together.

These upper and lower four-bar mechanisms function to maintain the load-supporting platform 32 and seat 34 in a fixed, nearly horizontal orientation (at slight angle $\alpha$ relative to horizontal, as discussed above) throughout the entire range of movement of the lower and upper support arms 24 and 26 between their respective stowed and deployed positions. Illustrated another way, due to the function of the upper and lower four-bar mechanisms, a first plane P1 passing through the load-supporting platform 32 and a second plane P2 passing through the base member 22 maintain a substantially parallel relationship with one another throughout the entire range of movement of the support mechanism 20 between its stowed and deployed positions (see FIG. 4).

Overall, the support mechanism 20 is relatively compact. When in its stowed position, as shown in FIG. 2, the upper and lower support arms 26 and 24 extend from the pivot bracket 50 generally adjacent to one another and in the same direction, occupying very little deck space and even less vertical space. Preferably, the upper and lower support arms 26 and 24 lie in the same substantially vertical plane throughout the entire range of movement between their respective stowed and deployed positions. As best shown in FIG. 4, when the support structure 20 is in its deployed position, the lower support arm 24 extends upwardly from the support surface 36 and generally in a first direction (generally to the left as viewed in FIG. 4), and the upper support arm 26 continues upwardly but generally in an opposite second direction (generally to the right as viewed in FIG. 4). Preferably, the lower and upper support arms 24 and 26 are of substantially the same length and, therefore, the load-supporting platform 32 and seat 34 are positioned substantially along the same vertical axis A about which the base portion 22 pivots. Also, due to meshed engagement of the above-described geared portions 60 and 62 of the lower and upper support arms 24 and 26, which requires the support arms 24 and 26 to move together throughout their entire range of movement, the load-supporting platform 32 and seat 34 move substantially along the same vertical axis A as the support arms 24 and 26 move between their respective stowed and deployed positions. Deck space is typically at a premium on most fishing boats, and this "over-the-center" movement of the seat 34 results in the overall support mechanism 20 occupying very little deck space.

As noted above, the support mechanism 20 also occupies very little vertical space, when the device is in its stowed position (FIG. 2), while still allowing a full range of motion of the support arms 24 and 26 and related components. Preferably, an angle $\beta$ defined by the lower and upper support arms 24 and 26 increases from about zero degrees when the support arms 24 and 26 are in their respective stowed positions to more than 180 degrees as the support arms 24 and 26 are moved toward their respective deployed positions, as shown in FIG. 4.

The base member 22 preferably includes a first stop member 70, which is adapted to engage against the lower support arm 24 (just above its proximal end 42) when the lower support arm 24 is in its deployed position, and thereby restrict movement of the lower support arm 24 beyond its deployed position. Preferably, the pivot bracket 50 also includes a second stop member 72, which is adapted to engage against the lower support arm 24 (just below its distal end 40) when the lower support arm 24 is in its deployed position, also restricting movement of the lower support arm 24 beyond its deployed position. Preferably, the lower support arm 24 includes recesses 80 and 82 (see FIG. 9) adapted to receive the stop members 70 and 72 when the lower support arm 24 is in its fully deployed position. As shown in FIG. 4, an angle $\gamma$ between the plane P2 and the lower support arm 24 increases from about zero degrees when the lower support arm 24 is in its stowed position to more than 90 degrees as the lower support arm 24 is moved to its deployed position. Thus, the lower support arm 24 is held in its deployed position against the first and second stop members 70 and 72 by gravity, by the weight of the rest of the support mechanism 20 above the lower support arm 24, and by any load resting thereon.

Similarly, load-supporting platform 32 preferably includes a third stop member 74, which is adapted to engage against the upper support arm 26 (just below its proximal end 46) when the upper support arm 26 is in its deployed position, and thereby restrict movement of the upper support arm 26 beyond its deployed position. Preferably, the pivot bracket 50 also includes a fourth stop member 76, which is adapted to engage against the upper support arm 26 (just above its distal end 44) when the upper support arm 26 is in its deployed position, also restricting movement of the upper support arm 26 beyond its deployed position. Preferably, the upper support arm 26 includes recesses 84 and 86 (see FIG. 8) adapted to receive the stop members 74 and 76 when the upper support arm 26 is in its fully deployed position. As shown in FIG. 4, an angle $\delta$ between the plane P1 and the upper support arm 26 increases from about zero degrees when the upper support arm 26 is in its stowed position to more than 90 degrees as the upper support arm 26 is moved to its deployed position. Thus, the upper support arm 26 also is held in its deployed position against the third and fourth stop members 74 and 76 by gravity.

Thus, in operation, a user may move the support mechanism 20 from its stowed position to its deployed position by lifting the seat 34 upwardly. In so doing, the lower and upper support arms 24 and 26 will move upwardly from their generally horizontal stowed positions (shown in FIG. 2), toward their deployed positions (shown in FIGS. 1 and 4). Momentum of the lifting motion will carry the lower and upper support arms 24 and 26 past a vertical orientation (i.e., the angles γ and δ will increase to and then beyond 90 degrees), until the lower and upper support arms 24 and 26 engage against the stop members 70, 72, 74 and 76. If momentum of the lifting motion alone is not sufficient to carry the lower and upper support arms 24 and 26 past a vertical orientation (e.g., because the lifting motion was too slow), then the user may simply "kick" the support arms to their fully deployed positions while lifting the seat 34. To return the support mechanism 20 to its stowed position from its deployed position, the user begins by lifting the seat 34 upwardly again, and momentum of the lifting motion should carry the lower and upper support arms 24 and 26 back past vertical (i.e., so that the angles γ and δ decrease to and then below 90 degrees). Gravity and the weight of the device will carry the support arms 24 and 26 the rest of the way back to their respective stowed positions. Again, if momentum of the lifting motion alone is not sufficient to carry the lower and upper support arms 24 and 26 back past vertical, then the user may simply "kick" the support arms back toward their stowed positions while lifting the seat 34.

In one preferred embodiment of the invention shown in FIG. 6, the support mechanism 20 further comprises a lanyard 80 for returning the support mechanism 20 to its stowed position. As shown in FIG. 6, the lanyard has a first end 82 that is preferably connected to the pivot bracket 50 and a distal second end with a handle or ring 84 that is adapted for manual engagement by the user. The lanyard 80 is adapted to transmit tensile force between its first and second ends 82 and 84, whereby application of a tensile force to the distal second end 84 by a user causes the pivot bracket 50 to move horizontally (to the right as viewed in FIGS. 4 and 6) and, consequently, the lower and upper support arms 24 and 26 are moved back toward their respective stowed positions. Also the lanyard 80 is shown as being connected to the pivot bracket 50, it should be understood that the same function could be accomplished in the same way to achieve the same result by connecting the lanyard 80 to either of the lower and upper support arms 24 and 26.

Although the present invention has been shown and described in reference to a support mechanism for a boat seat, it should be understood that the support mechanism of the present invention could be used to support other items, such as tables, shelves, other support surfaces, ladders, other support structures, etc., which are stowable or collapsible.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A support mechanism, the support mechanism comprising:

a base member adapted for supporting the support mechanism from a support surface;

a first support arm having a distal end pivotally connected to a pivot bracket and a proximal end operatively connected to the base member in a manner to permit pivoting movement of the first support arm relative to the support surface between a stowed position and a deployed position, the distal end of the first support arm being generally adjacent the support surface when the first support arm is in its stowed position and spaced from the support surface when the first support arm is in its deployed position, the distal end of the first support arm including a first geared portion;

a first synchronizing arm generally adjacent to the first support arm, the first synchronizing arm having a distal end pivotally connected to the pivot bracket and a proximal end operatively connected to the base member in a manner to permit pivoting movement of the first synchronizing arm relative to the support surface, the first synchronizing arm and first support arm being operatively connected to the pivot bracket and base member in a manner so that the first synchronizing arm and first support arm maintain a substantially parallel relationship with one another throughout the entire range of movement of the first support arm between its stowed and deployed positions;

a second support arm having a distal end pivotally connected to the pivot bracket and a proximal end operatively connected to a load-supporting platform in a manner to permit pivoting movement of the second support arm relative to the load-supporting platform between a stowed position and a deployed position, the distal end of the second support arm including a second geared portion; and a second synchronizing arm generally adjacent to the second support arm, the second synchronizing arm having a distal end pivotally connected to the pivot bracket and a proximal end operatively connected to the load-supporting platform in a manner to permit pivoting movement of the second synchronizing arm relative to the load-supporting platform, the second synchronizing arm and second support arm being operatively connected to the pivot bracket and load-supporting platform in a manner so that the second synchronizing arm and second support arm maintain a substantially parallel relationship with one another throughout the entire range of movement of the second support arm between its stowed and deployed positions;

the first and second support arms and first and second synchronizing arms being operatively connected with one another in a manner so that the load-supporting platform moves substantially along a fixed vertical axis as the first and second support arms move between their respective stowed and deployed positions, the first and second geared portions being in meshed engagement with one another throughout the entire range of movement of the first and second support arms between their respective stowed and deployed positions in manner such that movement of one of the first and second support arms between its stowed and deployed positions requires corresponding movement of the other of the first and second support arms between its stowed and deployed positions.

2. The support mechanism of claim 1 wherein the first and second support arms and first and second synchronizing arms are operatively connected with one another in a manner so that a first plane passing through the load-supporting platform and a second plane passing through the base member maintain a substantially parallel relationship with one another throughout the entire range of movement of the first and second support arms between their respective stowed and deployed positions.

3. The support mechanism of claim 1 wherein the first and second support arms extend from the pivot bracket generally in the same direction, when the first and second support arms are in their respective stowed positions.

4. The support mechanism of claim 1 wherein first and second support arms lie in the same substantially vertical plane throughout the entire range of movement of the first and second support arms between their respective stowed and deployed positions.

5. The support mechanism of claim 4 wherein the first support arm extends upwardly and generally in a first direction from the platform when the first support arm is in its deployed position, and wherein the second support arm extends upwardly and generally in an opposite second direction from the pivot bracket when the second support arm is in its deployed position.

6. The support mechanism of claim 1 wherein an angle defined by the first and second support arms increases from about zero degrees when the first and second support arms are in their respective stowed positions to more than 180 degrees as the first and second support arms are moved toward their respective deployed positions.

7. The support mechanism of claim 1 wherein at least one of the base member and pivot bracket includes a first stop member that engages against the first support arm to prevent pivoting movement of the first support arm beyond its deployed position, and wherein an angle between the support surface and first support arm increases from about zero degrees when the first support arm is in its stowed position to more than 90 degrees as the first support arm is moved toward its deployed position, whereby the first support arm is held in its deployed position against the first stop by gravity.

8. The support mechanism of claim 7 wherein at least one of the pivot bracket and load-supporting platform includes a second stop member that engages against the second support arm to prevent pivoting movement of the second support arm beyond its deployed position, and wherein an angle between the load-supporting platform and second support arm increases from about zero degrees when the second support arm is in its stowed position to more than 90 degrees as the second support arm is moved toward its deployed position, whereby the second support arm is held in its deployed position against the second stop by gravity.

9. The support mechanism of claim 1 wherein the base member is connected to the support surface in a manner to permit rotating movement of the support mechanism about a generally vertical axis.

10. A support mechanism, the support mechanism comprising:

a base member adapted for supporting the support mechanism from a support surface;

a first support arm having a distal end pivotally connected to a pivot bracket and a proximal end operatively connected to the base member in a manner to permit pivoting movement of the first support arm relative to the support surface between a stowed position and a deployed position, the distal end of the first support arm being generally adjacent the support surface when the first support arm is in its stowed position and spaced from the support surface when the first support arm is in its deployed position, the first support arm extending upwardly and generally in a first direction from the platform when the first support arm is in its deployed position;

a first synchronizing arm generally adjacent to the first support arm, the first synchronizing arm having a distal end pivotally connected to the pivot bracket and a proximal end operatively connected to the base member in a manner to permit pivoting movement of the first synchronizing arm relative to the support surface, the first synchronizing arm and first support arm being operatively connected to the pivot bracket and base member in a manner so that the first synchronizing arm and first support arm maintain a substantially parallel relationship with one another throughout the entire range of movement of the first support arm between its stowed and deployed positions;

a second support arm having a distal end pivotally connected to the pivot bracket and a proximal end operatively connected to a load-supporting platform in a manner to permit pivoting movement of the second support arm relative to the load-supporting platform between a stowed position and a deployed position, the second support arm extending upwardly and generally in an opposite second direction from the pivot bracket when the second support arm is in its deployed position;

a second synchronizing arm generally adjacent to the second support arm, the second synchronizing arm having a distal end pivotally connected to the pivot bracket and a proximal end operatively connected to the load-supporting platform in a manner to permit pivoting movement of the second synchronizing arm relative to the load-supporting platform, the second synchronizing arm and second support arm being operatively connected to the pivot bracket and load-supporting platform in a manner so that the second synchronizing arm and second support arm maintain a substantially parallel relationship with one another throughout the entire range of movement of the second support arm between its stowed and deployed positions; and a lanyard having a first end connected to at least one of the first support arm, second support arm and pivot bracket, the lanyard being adapted to transmit tensile force between the first end and a distal second end, whereby application of a tensile force to the distal second end of the lanyard generally in the second direction causes the first and second support arms to move back to their respective stowed positions;

the first and second support arms and first and second synchronizing arms being operatively connected with one another in a manner so that the load-supporting platform moves substantially along a fixed vertical axis as the first and second support arms move between their respective stowed and deployed positions.

11. A support mechanism, the support mechanism comprising:

a base member adapted for supporting the support mechanism from a support surface;

a first support arm having a distal end pivotally connected to a pivot bracket and a proximal end operatively connected to the base member in a manner to permit pivoting movement of the first support arm relative to the support surface between a stowed position and a deployed position, the distal end of the first support arm being generally adjacent the support surface when the first support arm is in its stowed position and spaced from the support surface when the first support arm is in its deployed position, the distal end of the first support arm including a first geared portion;

a first synchronizing arm generally adjacent to the first support arm, the first synchronizing arm having a distal end pivotally connected to the pivot bracket and a proximal end operatively connected to the base member in a manner to permit pivoting movement of the first synchronizing arm relative to the support surface, the first synchronizing arm and first support arm being operatively connected to the pivot bracket and base member in a manner so that the first synchronizing arm and first support arm maintain a substantially parallel relationship with one another throughout the entire range of movement of the first support arm between its stowed and deployed positions:

a second support arm having a distal end pivotally connected to the pivot bracket and a proximal end operatively connected to a load-supporting platform in a manner to permit pivoting movement of the second support arm relative to the load-supporting platform between a stowed position and a deployed position, the distal end of the second support arm including a second geared portion; and a second synchronizing arm generally adjacent to the second support arm, the second synchronizing arm having a distal end pivotally connected to the pivot bracket and a proximal end operatively connected to the load-supporting platform in a manner to permit pivoting movement of the second synchronizing arm relative to the load-supporting platform, the second synchronizing arm and second support arm being operatively connected to the pivot bracket and load-supporting platform in a manner so that the second synchronizing arm and second support arm maintain a substantially parallel relationship with one another throughout the entire range of movement of the second support arm between its stowed and deployed positions;

the first and second support arms and first and second synchronizing arms being operatively connected with one another in a manner so that a first plane passing through the load-supporting platform and a second plane passing through the base member maintain a substantially parallel relationship with one another throughout the entire range of movement of the first and second support arms between their respective stowed and deployed positions, the first and second geared portions being in meshed engagement with one another throughout the entire range of movement of the first and second support arms between their respective stowed and deployed positions in a manner such that movement of one of the first and second support arms between its stowed and deployed positions requires corresponding movement of the other of the first and second support arms between its stowed and deployed positions.

12. The support mechanism of claim 11 wherein the first and second support arms and first and second synchronizing arms are operatively connected with one another in a manner so that the load-supporting platform moves substantially along a fixed vertical axis as the first and second support arms move between their respective stowed and deployed positions.

13. The support mechanism of claim 11 wherein the load-supporting platform is spaced a first distance from the support surface when the first and second support arms are in their respective stowed positions and spaced a second distance from the support surface when the first and second support arms are in their respective deployed positions, the second distance being greater than the first distance.

14. The support mechanism of claim 11 wherein first and second support arms lie in the same substantially vertical plane throughout the entire range of movement of the first and second support arms between their respective stowed and deployed positions.

15. The support mechanism of claim 14 wherein the first support arm extends upwardly and generally in a first direction from the platform when the first support arm is in its deployed position, and wherein the second support arm extends upwardly and generally in an opposite second direction from the pivot bracket when the second support arm is in its deployed position.

16. The support mechanism of claim 11 wherein an angle defined by the first and second support arms increases from about zero degrees when the first and second support arms are in their respective stowed positions to more than 180 degrees as the first and second support arms are moved toward their respective deployed positions.

17. The support mechanism of claim 11 wherein at least one of the base member and pivot bracket includes a first stop member that engages against the first support arm to prevent pivoting movement of the first support arm beyond its deployed position, and wherein an angle between the support surface and first support arm increases from about zero degrees when the first support arm is in its stowed position to more than 90 degrees as the first support arm is moved toward its deployed position, whereby the first support arm is held in its deployed position against the first stop by gravity.

18. The support mechanism of claim 17 wherein at least one of the pivot bracket and load-supporting platform includes a second stop member that engages against the second support arm to prevent pivoting movement of the second support arm beyond its deployed position, and wherein an angle between the load-supporting platform and second support arm increases from about zero degrees when the second support arm is in its stowed position to more than 90 degrees as the second support arm is moved toward its deployed position, whereby the second support arm is held in its deployed position against the second stop by gravity.

19. The support mechanism of claim 11 wherein the base member is connected to the support surface in a manner to permit rotating movement of the support mechanism about a generally vertical axis.

20. A support mechanism, the support mechanism comprising:

a base member adapted for supporting the support mechanism from a support surface;

a first support arm having a distal end pivotally connected to a pivot bracket and a proximal end operatively connected to the base member in a manner to permit pivoting movement of the first support arm relative to the support surface between a stowed position and a deployed position, the distal end of the first support arm being generally adjacent the support surface when the first support arm is in its stowed position and spaced from the support surface when the first support arm is in its deployed position, the first support arm extending upwardly and generally in a first direction from the platform when the first support arm is in its deployed positions;

a first synchronizing arm generally adjacent to the first support arm, the first synchronizing arm having a distal end pivotally connected to the pivot bracket and a proximal end operatively connected to the base member in a manner to permit pivoting movement of the first synchronizing arm relative to the support surface, the first synchronizing arm and first support arm being operatively connected to the pivot bracket and base member in a manner so that the first synchronizing arm and first support arm maintain a substantially parallel relationship with one another throughout the entire range of movement of the first support arm between its stowed and deployed positions;

second support arm having a distal end pivotally connected to the pivot bracket and a proximal end operatively connected to a load-supporting platform in a manner to permit pivoting movement of the second support arm relative to the load-supporting platform between a stowed position and a deployed position, the second support arm extending upwardly and generally in an opposite second direction from the pivot bracket when the second support arm is in its deployed position;

a second synchronizing arm generally adjacent to the second support arm, the second synchronizing arm having a distal end pivotally connected to the pivot bracket and a proximal end operatively connected to the load-supporting platform in a manner to permit pivoting movement of the second synchronizing arm relative to the load-supporting platform, the second synchronizing arm and second support arm being operatively connected to the pivot bracket and load-supporting platform in a manner so that the second synchronizing arm and second support arm maintain a substantially parallel relationship with one another throughout the entire range of movement of the second support arm between its stowed and deployed positions; and a lanyard having a first end connected to at least one of the first support arm, second support arm and pivot bracket, the lanyard being adapted to transmit tensile force between the first end and a distal second end, whereby application of a tensile force to the distal second end of the lanyard generally in the second direction causes the first and second support arms to move back to their respective stowed positions;

the first and second support arms and first and second synchronizing arms being operatively connected with one another in a manner so that a first plane passing through the load-supporting platform and a second plane passing through the base member maintain a substantially parallel relationship with one another throughout the entire range of movement of the first and second support arms between their respective stowed and deployed positions.

21. A support mechanism, the support mechanism comprising:

a base member adapted for supporting the support mechanism from a support surface;

a first support arm having a distal end pivotally connected to a pivot bracket and a proximal end operatively connected to the base member in a manner to permit pivoting movement of the first support arm relative to the support surface between a stowed position and a deployed position, the distal end of the first support arm being generally adjacent the support surface when the first support arm is in its stowed position and spaced from the support surface when the first support arm is in its deployed position, the distal end of the first support arm having a first geared portion;

a first synchronizing arm generally adjacent to the first support arm, the first synchronizing arm having a distal end pivotally connected to the pivot bracket and a proximal end operatively connected to the base member in a manner to permit pivoting movement of the first synchronizing arm relative to the support surface, the first synchronizing arm and first support arm being operatively connected to the pivot bracket and base member in a manner so that the first synchronizing arm and first support arm maintain a substantially parallel relationship with one another throughout the entire range of movement of the first support arm between its stowed and deployed positions;

a second support arm having a distal end pivotally connected to the pivot bracket and a proximal end operatively connected to a load-supporting platform in a manner to permit pivoting movement of the second support arm relative to the load-supporting platform between a stowed position and a deployed position, the distal end of the second support arm having a second geared portion; and a second synchronizing arm generally adjacent to the second support arm, the second synchronizing arm having a distal end pivotally connected to the pivot bracket and a proximal end operatively connected to the load-supporting platform in a manner to permit pivoting movement of the second synchronizing arm relative to the load-supporting platform, the second synchronizing arm and second support arm being operatively connected to the pivot bracket and load-supporting platform in a manner so that the second synchronizing arm and second support arm maintain a substantially parallel relationship with one another throughout the entire range of movement of the second support arm between its stowed and deployed positions;

wherein the first and second support arms are connected to the pivot bracket in a manner so that the first and second geared portions are in meshed engagement with one another throughout the entire range of movement of the first and second support arms between their respective stowed and deployed positions, whereby movement of one of the first and second support arms between its stowed and deployed positions requires corresponding movement of the other of the first and second support arms between its stowed and deployed positions.

22. The support mechanism of claim 21 wherein the first and second support arms and first and second synchronizing arms are operatively connected with one another in a manner so that the load-supporting platform moves substantially along a fixed vertical axis as the first and second support arms move between their respective stowed and deployed positions.

23. The support mechanism of claim 21 wherein the first and second support arms and first and second synchronizing arms are operatively connected with one another in a manner so that a first plane passing through the load-supporting platform and a second plane passing through the base member maintain a substantially parallel relationship with one another throughout the entire range of movement of the first and second support arms between their respective stowed and deployed positions.

24. The support mechanism of claim 21 wherein first and second support arms lie in the same substantially vertical plane throughout the entire range of movement of the first and second support arms between their respective stowed and deployed positions.

25. The support mechanism of claim 24 wherein the first support arm extends upwardly and generally in a first direction from the platform when the first support arm is in its deployed position, and wherein the second support arm extends upwardly and generally in an opposite second direction from the pivot bracket when the second support arm is in its deployed position.

26. The support mechanism of claim 21 wherein an angle defined by the first and second support arms increases from about zero degrees when the first and second support arms are in their respective stowed positions to more than 180 degrees as the first and second support arms are moved toward their respective deployed positions.

27. The support mechanism of claim 21 wherein at least one of the base member and pivot bracket includes a first stop member that engages against the first support arm to prevent pivoting movement of the first support arm beyond its deployed position, and wherein an angle between the support surface and first support arm increases from about zero degrees when the first support arm is in its stowed position to more than 90 degrees as the first support arm is moved toward its deployed position, whereby the first support arm is held in its deployed position against the first stop by gravity.

28. The support mechanism of claim 27 wherein at least one of the pivot bracket and load-supporting platform includes a second stop member that engages against the second support arm to prevent pivoting movement of the second support arm beyond its deployed position, and wherein an angle between the load-supporting platform and second support arm increases from about zero degrees when the second support arm is in its stowed position to more than 90 degrees as the second support arm is moved toward its deployed position, whereby the second support arm is held in its deployed position against the second stop by gravity.

29. The support mechanism of claim 21 wherein the first support arm extends upwardly and generally in a first direction from the platform when the first support arm is in its deployed position, and wherein the second support arm extends upwardly and generally in an opposite second direction from the pivot bracket when the second support arm is in its deployed position, and wherein the support mechanism further comprises a lanyard with a first end connected to at least one of the first support arm, second support arm and pivot bracket, the lanyard being adapted to transmit tensile force between the first end and a distal second end, whereby application of a tensile force to the distal second end of the lanyard generally in the second direction causes the first and second support arms to move back to their respective stowed positions.

30. The support mechanism of claim 21 wherein the base member is connected to the support surface in a manner to permit rotating movement of the support mechanism about a generally vertical axis.

* * * * *